US006864455B2

(12) United States Patent
Chou

(10) Patent No.: US 6,864,455 B2
(45) Date of Patent: Mar. 8, 2005

(54) FUNCTION SWITCH FOR AN APPARATUS

(75) Inventor: Chi-Wen Chou, Hsi Chih (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/865,308

(22) Filed: Jun. 10, 2004

(65) Prior Publication Data

US 2004/0262144 A1 Dec. 30, 2004

(30) Foreign Application Priority Data

Jun. 24, 2003 (TW) ..... 92211517 U

(51) Int. Cl.[7] ..... H01H 21/50
(52) U.S. Cl. ..... 200/565; 200/336; 200/4
(58) Field of Search ..... 200/4, 11 R–11 TW, 200/564, 565, 570, 571, 336

(56) References Cited

U.S. PATENT DOCUMENTS 5,821,480 A * 10/1998 Machida ..... 200/4
5,927,486 A * 7/1999 Kamiya ..... 200/565
5,954,192 A * 9/1999 Iitsuka ..... 200/336
6,067,424 A * 5/2000 Shono ..... 396/297
6,236,002 B1 * 5/2001 Chou ..... 200/4
6,384,357 B1 * 5/2002 Morrison ..... 200/520
6,441,325 B2 * 8/2002 Takahashi et al. ..... 200/4
6,506,984 B2 * 1/2003 Tomita ..... 200/11 R

* cited by examiner

*Primary Examiner*—Michael A. Friedhofer
(74) *Attorney, Agent, or Firm*—Ladas & Parry LLP

(57) ABSTRACT

A function switch includes a switch base fixed to an apparatus and formed with a plurality of angularly spaced pitches, a knob, base disposed rotatably within an annular opening in the switch base, an external knob disposed on the switch seat and connected securely to the knob base for co-rotation therewith, and a spring member fixed to the knob base and having a resilient extension portion with engaging tongue slidably engaging the switch base to prevent removal therebetween. The engaging tongue collides against a respective groove to generate a clicking sound when the external knob is turned together with the knob base with respect to the switch base.

9 Claims, 5 Drawing Sheets

FUNCTION SWITCH FOR AN APPARATUS

FIELD OF THE INVENTION

The invention relates to a function switch, more particularly to a function switch of an electronic apparatus, such a digital camera, for selecting a predetermined function of the apparatus.

BACKGROUND OF THE INVENTION

A digital camera, being small in volume and capable of storing a great number of optical images, is greatly preferred to and is appreciated by the user, and thus becomes a popular demand in the market trench. No film roll is needed to take picture or views or persons, and therefore there is no problem of rinsing and developing the negative film.

Referring to FIG. 1, a conventional function switch 10 is mounted on a digital camera 12 for selecting a predetermined function mode since the digital camera 12 has a plurality of function modes, such as selecting view mode, continuous shooting mode, night view mode and etc., which are generally controlled and selected by the function switch 10. The function switch 10 is mounted on the camera 12 in such a manner that the function switch 10 generates a clicking sound upon arriving a selected function mode.

The conventional function switch 10 is complicated in structure, and includes a plurality of components so that the manufacturing cost thereof is relatively high. The function switch 10 frequently runs into a jam due to its complicated structure, and hinders smooth operation of the digital camera.

SUMMARY OF THE INVENTION

The object of the present invention is to provide a function switch for an apparatus, the function switch is simple in structure and is turnable on the apparatus so as to select a predetermined function of the apparatus. The function switch generates a clicking sound upon arriving at the predetermined function mode.

A function switch of the present invention is used in an apparatus for selecting a predetermined function thereof and includes: an external knob having an outer periphery which is adapted to be turned by a user so as to select the predetermined function; a knob base connected to a bottom portion of the external knob so as to be co-rotatable therewith; a stationary switch seat adapted to be mounted securely on the apparatus, and disposed around the knob base in such a manner that the external knob is disposed on an upper surface of the stationary switch seat, the stationary switch seat having a lower surface that is opposite to the upper surface and that is formed with a plurality of spaced apart pitches, an adjacent pair of the pitches defining an arcuate traveling path therebetween; a fastener; and a resilient spring member having a mounting portion fixed on a lower surface of the knob base by the fastener, and an extension portion extending resiliently angularly from the mounting portion and formed with an engaging tongue that bias slidably and resiliently against the arcuate traveling path, thereby preventing upward removal of the external knob from the switch base, whereby the external knob generating a clicking sound by virtue of collision of the engaging tongue against a respective one of the pitches due to co-turning of the external knob, the knob base and the spring member with respect to the stationary switch seat when the external knob is turned to the predetermined function.

BRIEF DESCRIPTION OF THE DRAWING

Other features and advantages of this invention will become more apparent in the following detailed description of the preferred embodiment of this invention, with reference to the accompanying drawings, in which.

DETAILED DESCRIPTIONS OF THE PREFERRED EMBODIMENT

Figure 1:
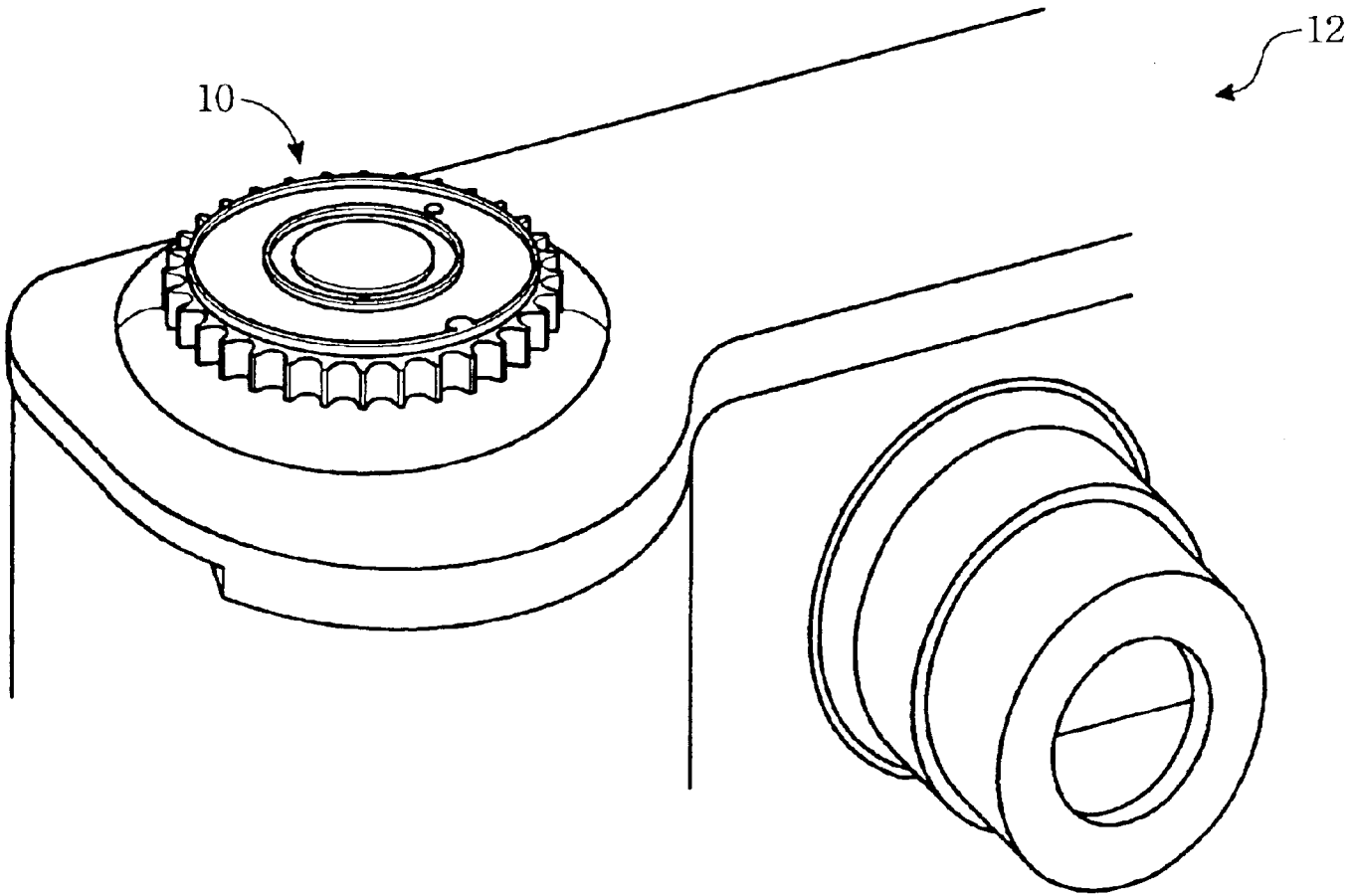
FIG. 1 (Prior Art)
FIG. 1 is a fragmentary perspective view of a digital camera provided with a function switch.
Figure 2A:
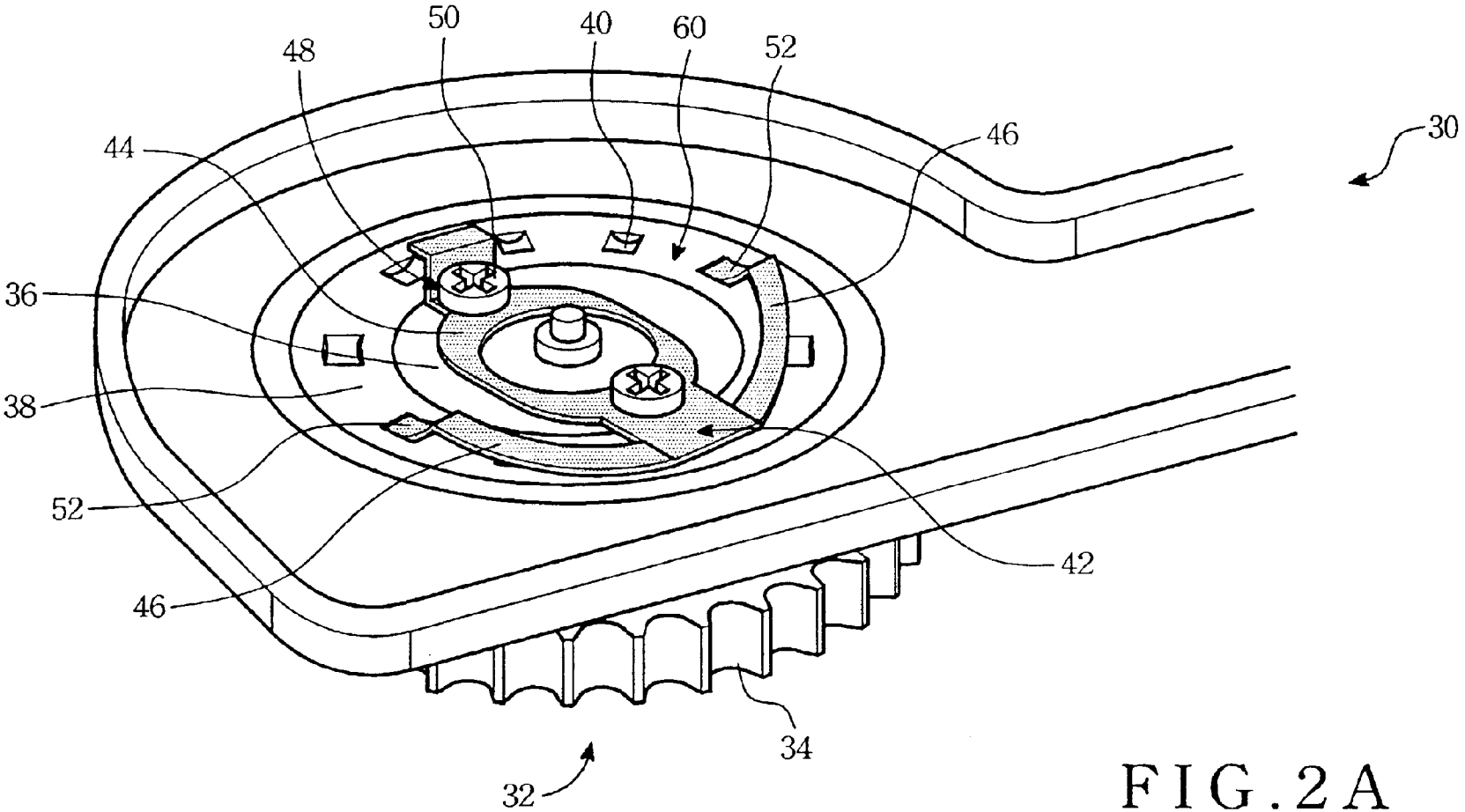
FIG. 2A is a fragmentary view of a digital camera provided with the preferred embodiment of a function switch of the present invention.
Figure 2B:
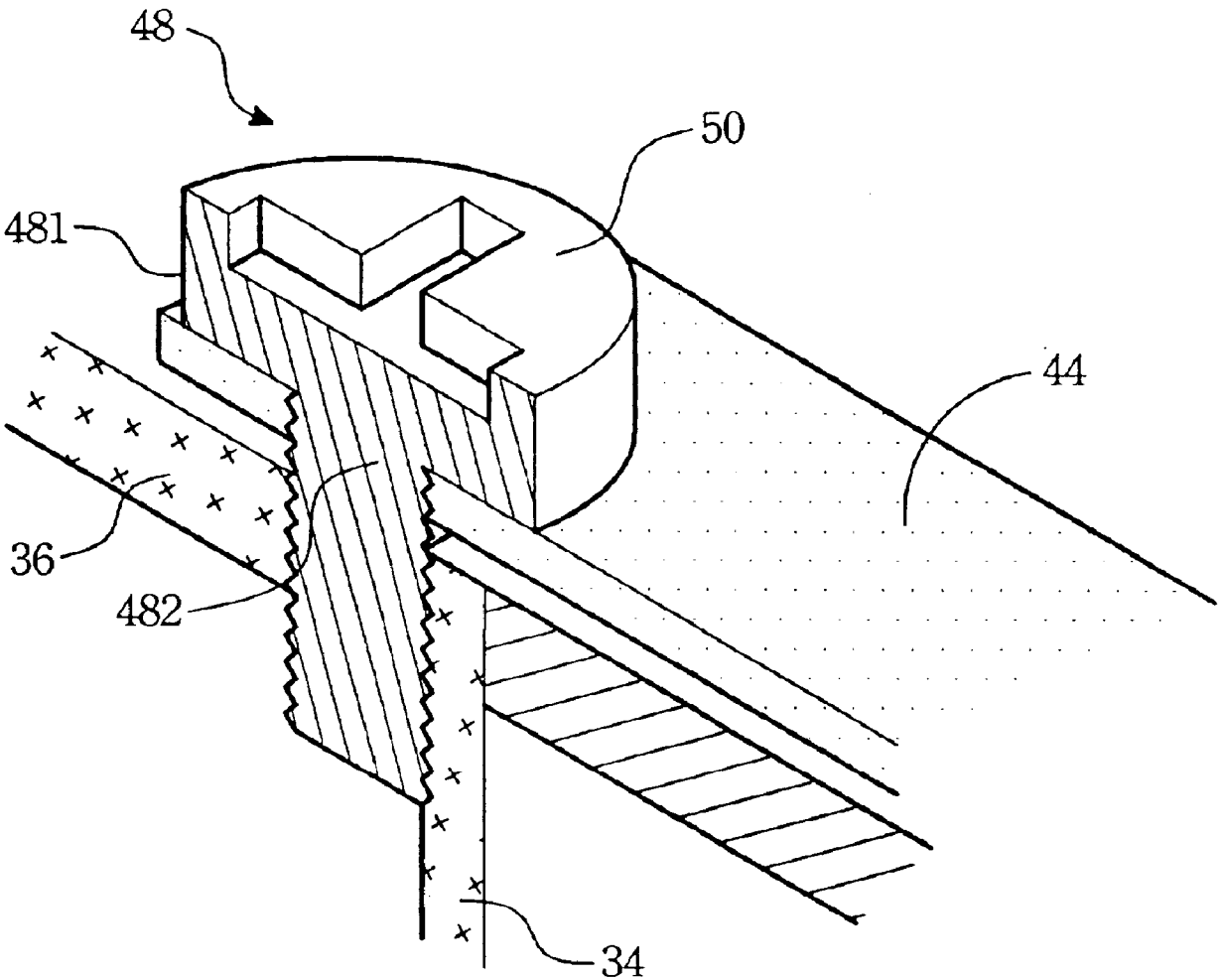
FIG. 2B is a sectional view of a portion of the preferred embodiment when mounted on the digital camera.
Figure 3:
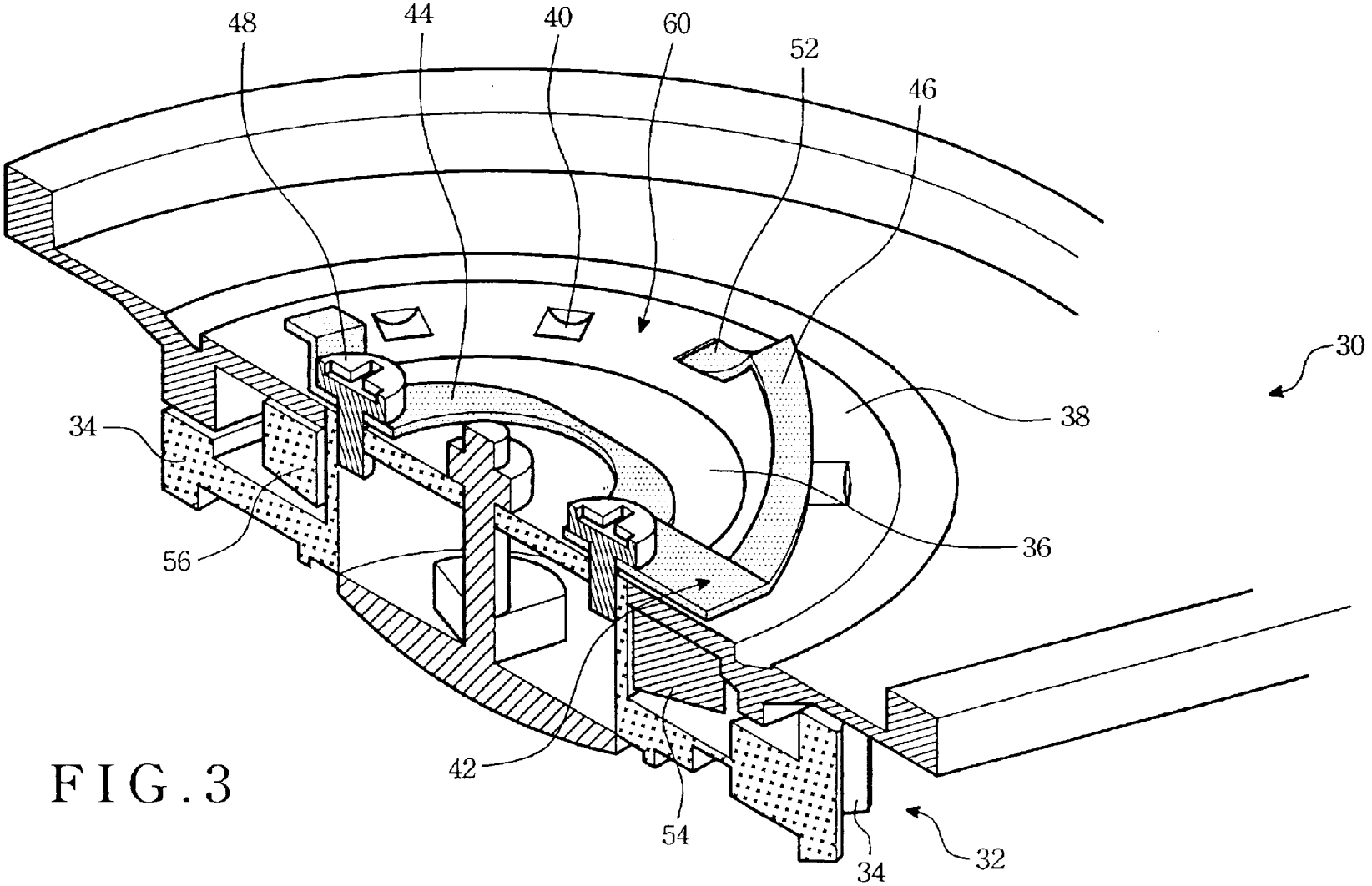
FIG. 3 is a sectional view of the preferred embodiment when mounted on the digital camera.

Referring to FIGS. 2A, 2B, and 3, the preferred embodiment of a function switch 32 is mounted on an apparatus 30, such as a camera, for selecting a predetermined function, and includes a stationary switch seat 38, a knob base 36, an external knob 34, two fasteners 50, and a spring member 42.

As illustrated, the stationary switch seat 38 is mounted securely on the apparatus, and has a lower surface formed with a plurality of pitches 40 which are angularly and equidistantly spaced from one another, an upper surface opposite to the lower surface and flush with an outer surface of the apparatus, and an inner periphery portion defining an annular opening. An adjacent pair of the pitches 40 defines an arcuate traveling path 60 therebetween.

Figure 4:
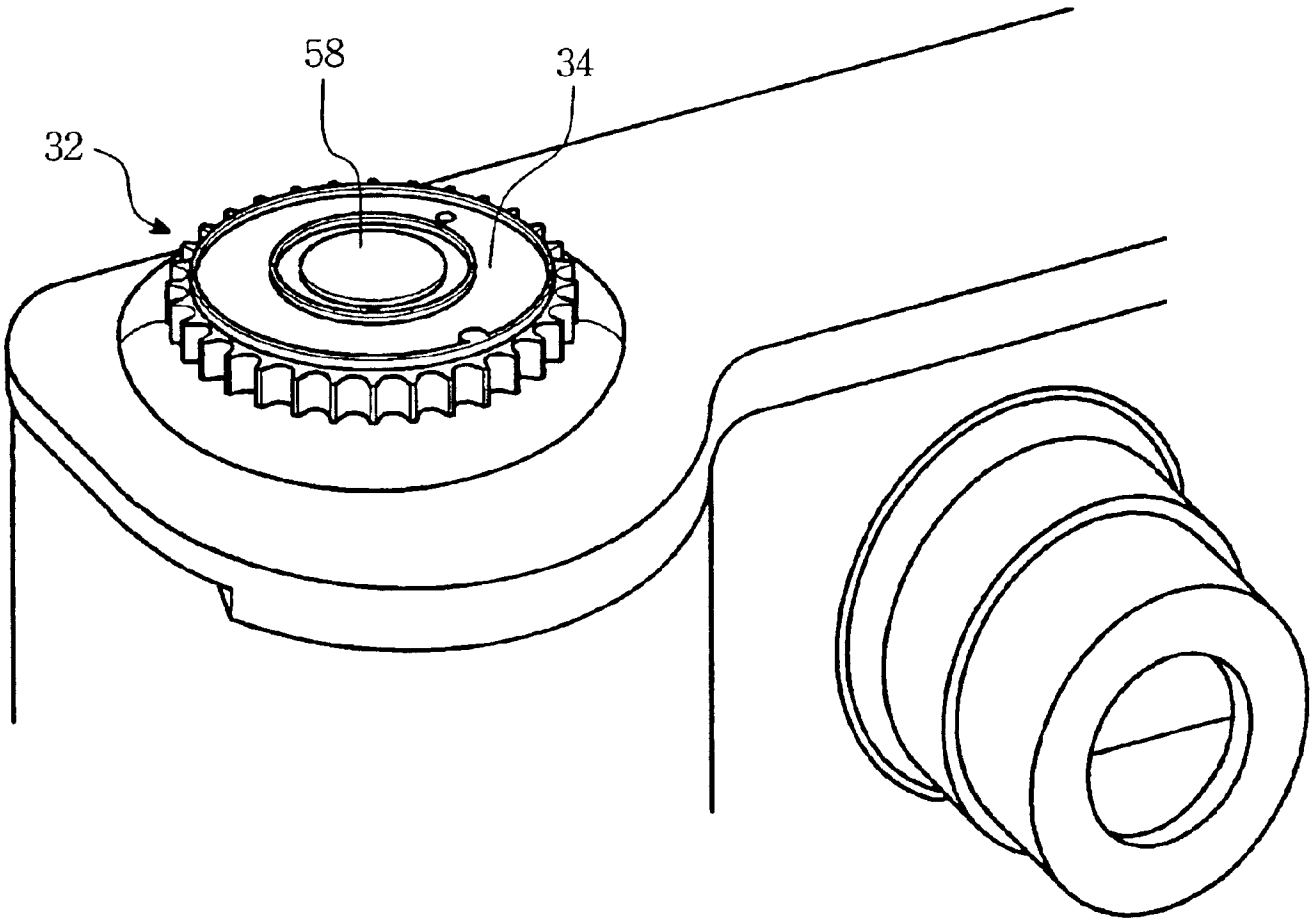
FIG. 4 is a perspective view the preferred embodiment of the function switch according to the present invention when mounted on the digital camera.

The knob base 36 is disposed rotatably within the annular opening in the stationary switch seat 38, and is connected to a bottom portion of the external knob 34 so as to be co-rotatable therewith. The external knob 34 has an inner diameter larger than that of the knob base 36, is therefore disposed on the upper surface of the stationary switch base 38 (see FIG. 4). The external knob 34 further has an outer periphery which is adapted to be turned by a user so as to select the predetermined function of the apparatus 30.

The spring member 42 includes two opposite mounting portions .44 that are secured the lower surface of the knob base 36 via the fasteners 50 in such a manner that each of the mounting portions 44 cooperates with the knob base 36 to define a gap therebetween (see FIG. 2B), and two extension portions 46 that extend resiliently angularly from one of the mounting portions 44, that are symmetrically opposite to each other and that are respectively formed with engaging tongues 52. After assembly, the engaging tongues 52 of the spring member 42 bias slidably and resiliently against the corresponding arcuate traveling paths, thereby preventing upward removal of the external knob 34 from the stationary switch base 38 (see FIG. 4). When the external knob 34 is turned to the predetermined function, the external knob 34 generates a clicking sound by virtue of collision of the engaging tongues 52 synchronously against respective two of the pitches 40 due to co-turning of the external knob 34, the knob base 36 and the spring member.42 with respect to the stationary switch seat 38.

In this preferred embodiment, each of the fasteners 50 is a screw 48, and has an enlarged head 481 and a shank 482 that extends through the respective mounting portion 44 of the spring member 42 and that fastens threadedly the knob base 36 in such a manner to define the gap therebetween. Under this condition, the mounting portions 44 will vibrate upon receipt of a vibration force caused when the external knob 34 is turned to the predetermined function. The clicking sound is subsequently enhanced due to collision between the head 481 of the screw 48 and the mounting portion 44 of the spring member 42 by virtue of presence of the gap.

Preferably, a metal piece can be mounted on a bottom of a respective one of the pitches 40 in the lower surface of the switch base 38 in order to enhance the clicking sound.

Referring to FIG. 3, the preferred embodiment further includes a first limiting member 54 that is connected to the stationary switch seat 38 and that is disposed between the stationary switch seat 38 and the external knob 34, and a second limiting member 56 that is secured to the bottom portion of the external knob 34, that is disposed between the stationary switch seat 38 and the external knob 34, and that interferes the first limiting member 54 when the external knob 34 is turned relative to the stationary switch seat 38 so as to restrict angular movement of the external knob 34 relative to the stationary switch seat 38. The external knob 34 can be in the form of a hollow tube having one end portion exposed from the stationary switch seat 38. The function switch 32 further includes a press button 58 mounted on the end portion of the hollow tube for operating the function of the apparatus.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A function switch adapted to be mounted on an apparatus for selecting a predetermined function, the function switch comprising:

an external knob having an outer periphery which is adapted to be turned by a user so as to select the predetermined function;

a knob base connected to a bottom portion of said external knob so as to be co-rotatable therewith;

a stationary switch seat adapted to be mounted securely on the apparatus, and disposed around said knob base in such a manner that said external knob is disposed on an upper surface of said stationary switch seat, said stationary switch seat having a lower surface that is opposite to said upper surface and that is formed with a plurality of spaced apart pitches, an adjacent pair of said pitches defining an arcuate traveling path therebetween;

a fastener; and a resilient spring member having a mounting portion fixed on a lower surface of said knob base by said fastener, and an extension portion extending resiliently angularly from said mounting portion and formed with an engaging tongue that bias slidably and resiliently against said arcuate traveling path, thereby preventing upward removal of said external knob from said stationary switch base, said external knob generating a clicking sound by virtue of collision of said engaging tongue against a respective one of said pitches according to co-turning of said external knob, said knob base and said spring member with respect to said stationary switch seat when said external knob is turned to the predetermined function.

2. The function switch according to claim 1, wherein said fastener is a screw.

3. The function switch according to claim 2, wherein said screw includes a head and a shank that extends through said mounting portion of said spring member and that fastens threadedly said knob base in such a manner that said mounting portion cooperates with said knob base to define a gap therebetween.

4. The function switch according to claim 3, wherein the clicking sound is further enhanced according to collision between said head of said screw and said mounting portion of said spring member by virtue of presence of said gap, said mounting portion being vibrated upon receipt of a vibration force caused when said external knob is turned to the predetermined function.

5. The function switch according to claim 4, further comprising a metal piece mounted on a bottom of a respective one of said pitches.

6. The function switch according to claim 1, further comprising a first limiting member that is connected to said stationary switch seat and that is disposed between said stationary switch seat and said external knob, and a second limiting member that is secured to said bottom portion of said external knob, that is disposed between said stationary switch seat and said external knob, and that interferes with said first limiting member when said external knob is turned relative to said stationary switch seat so as to restrict angular movement of said external knob relative to said stationary switch seat.

7. The function switch according to claim 1, wherein said external knob is in the form of a hollow tube having one end portion exposed from said stationary switch seat, said function switch further comprising a press button mounted on said end portion of said hollow tube/for operating the function of the apparatus.

8. The function switch according to claim 1, wherein said spring member includes two of said extension portions is which are symmetrically opposite to each other, and which are formed with two of said engaging tongues that bias slidably and resiliently against two opposite said arcuate traveling paths of said stationary switch seat in such a manner that said engaging tongues synchronously extend into two corresponding said pitches when said external knob is turned to the predetermined function.

9. The function switch according to claim 1, wherein said pitches in said lower surface of said stationary switch seat are angularly and equidistantly spaced from one another.

* * * * *